United States Patent [19]

Kohyama

[11] Patent Number: 4,992,830

[45] Date of Patent: Feb. 12, 1991

[54] IMAGE RECORDING APPARATUS THAT PREVENTS TONER DISPERSION

[75] Inventor: Mitsuaki Kohyama, Higashikurume, Japan

[73] Assignee: Kabushiki Kaisha Toshiba, Kawasaki, Japan

[21] Appl. No.: 494,448

[22] Filed: Mar. 16, 1990

[30] Foreign Application Priority Data

Mar. 17, 1989 [JP] Japan ..... 1-63801

[51] Int. Cl.[5] ..... G03G 21/00

[52] U.S. Cl. ..... 355/215; 355/298

[58] Field of Search ..... 355/215, 270, 284, 298; 430/33, 80, 109; 350/582

[56] References Cited

U.S. PATENT DOCUMENTS 4,252,435 2/1981 Manghirmalani ..... 355/298 X 4,466,813 8/1984 Avritt et al. ..... 355/215

4,931,370 6/1990 Amaya et al. ..... 430/109

FOREIGN PATENT DOCUMENTS 0136056 8/1983 Japan ..... 355/215

*Primary Examiner*—A. T. Grimley

*Assistant Examiner*—Sandra L. Hoffman

*Attorney, Agent, or Firm*—Foley & Lardner, Schwartz, Jeffery, Schwaab, Mack, Blumenthal & Evans

[57] ABSTRACT

In an image recording apparatus according to the present invention, a developing device and removing means are constituted as one unit, and the unit is freely inserted into and removed from the apparatus body. When an image is formed or when the unit is inserted or removed, developing powder, which is dispersed or fallen from the opening of the unit, is received by a developing powder receiving section, and the powder is chemically softened or melted.

12 Claims, 2 Drawing Sheets

IMAGE RECORDING APPARATUS THAT PREVENTS TONER DISPERSION

BACKGROUND OF THE INVENTION

1. Field of the Invention

The present invention relates to an image recording apparatus such as an electronic copying machine, and, in particular, to an image recording apparatus wherein an electrostatic latent image or a magnetic latent image is developed by applying developing powder thereto.

2. Description of the Related Art

In an electrophotographic apparatus, an electrostatic recording apparatus, or a magnetic recording apparatus (hereinafter, generally referred to as "recording apparatus"), developing powder is supplied from an opening of a developing device onto an electrostatic latent image formed on a photosensitive drum, so that the latent image is developed. The developed image is transferred onto a paper sheet by means of a transfer charger. The developed image is transferred, the developing powder remaining on the photosensitive drum is scraped off by a cleaning device. The scraped powder is taken into the cleaning device through an opening formed in the cleaning device.

In the above apparatus, there is a concern that the developing powder supplied from the developing device or scraped off by the cleaning device is dispersed or fallen, while it passes through the opening of the developing device or the cleaning device, thus contaminating the inside of the apparatus.

This being the case, in a conventional apparatus, a receiving member is arranged in the vicinity of the opening of the developing device or the cleaning device. The receiving member receives the developing powder which is dispersed or fallen from the opening of the developing device or the cleaning device. Thus, the contamination of the inside of the apparatus is prevented.

The conventional receiving member is formed of synthetic resin or metal such as aluminum, and this receiving member is formed simply in a dish-like shape. Thus, when a great deal of developing powder is accumulated on the receiving member, or when the receiving member is vibrated, the developing powder is fallen from the receiving member. In particular, in the case where the developing device or the cleaning device is removably mounted in the recording apparatus, if the receiving member is tilted or jolted during the removal of the developing device or cleaning device, the developing powder may be fallen out of the receiving member, thus contaminating the inside of the apparatus, or the surface of a desk or the floor. For this reason, it is difficult for a general user to remove the developing device or the cleaning device from the apparatus. This prevents recording apparatuses of this type from widely prevailing.

It has also been proposed to use magnetic toner, in place of the developing powder, and to arrange a magnet, in lieu of the receiving member, in a region where the magnetic toner may fall or disperse. The fallen or dispersed toner is attracted by the magnet, thus preventing the contamination due to the toner.

In this technique, however, the cost of developing agent rises, and the choice of the color of toner is restricted by the color of magnetic material used in the apparatus.

Furthermore, it has been proposed to arrange an adhesive member in the vicinity of the opening of the developing device or the cleaning device, so that the developing powder is caught on the adhesive member. In this technique, however, once the surface of the adhesive member is covered with toner, the adhesive member does not function. Thus, this adhesive member cannot be used for a long time, and a great deal of toner cannot be attached to the adhesive member.

These problems are serious in a recording apparatus in which a developing device, etc. are frequently attached and replaced. In a so-called "process unit" wherein a photosensitive device, a developing device, a cleaning device, etc. are assembled in as one body and are replaced at one time, even the fall of a small amount of developer is not ignorable.

For the reasons stated above, there is an increasing expectancy for the advent of means for effectively preventing the fall or dispersion of toner, irrespective of the type of developer or the developing method.

SUMMARY OF THE INVENTION

The object of the present invention is to provide an image recording apparatus, wherein dispersion or falling of developing powder, which occurs within and without the recording apparatus, can be prevented.

According to the present invention, there is provided an apparatus which comprises an image recording apparatus for forming an image on a recording medium, which comprises an image bearing member; means for forming the latent image on said image bearing member for developing the latent image on said image bearing member means with a developing powder; means for transferring the developed image formed on said carrying means to the recording medium; means for removing the developing powder remaining on the image bearing member to clean the image bearing member, after the developed image is transferred onto the recording medium; and a unit having said developing means and said removing means; means for housing said receiving unit, said image forming means and said transferring means, said receiving unit being detachably mounted in said housing means; means for collecting the developing powder which is dispersed or fallen from said unit, which includes means for chemically processing the collected developed powder.

According to the present invention there is also provided an apparatus for forming an image on a recording medium, which comprises an image bearing member, means for acting on said image bearing member, a unit having said image bearing member and said acting means, and removably locatable on a body of said apparatus, means for collecting a developing powder which is dispersed or fallen from said unit, which includes means for chemically processing the collected developed powder.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will now be described with reference to the accompanying drawings.

Figure 1:
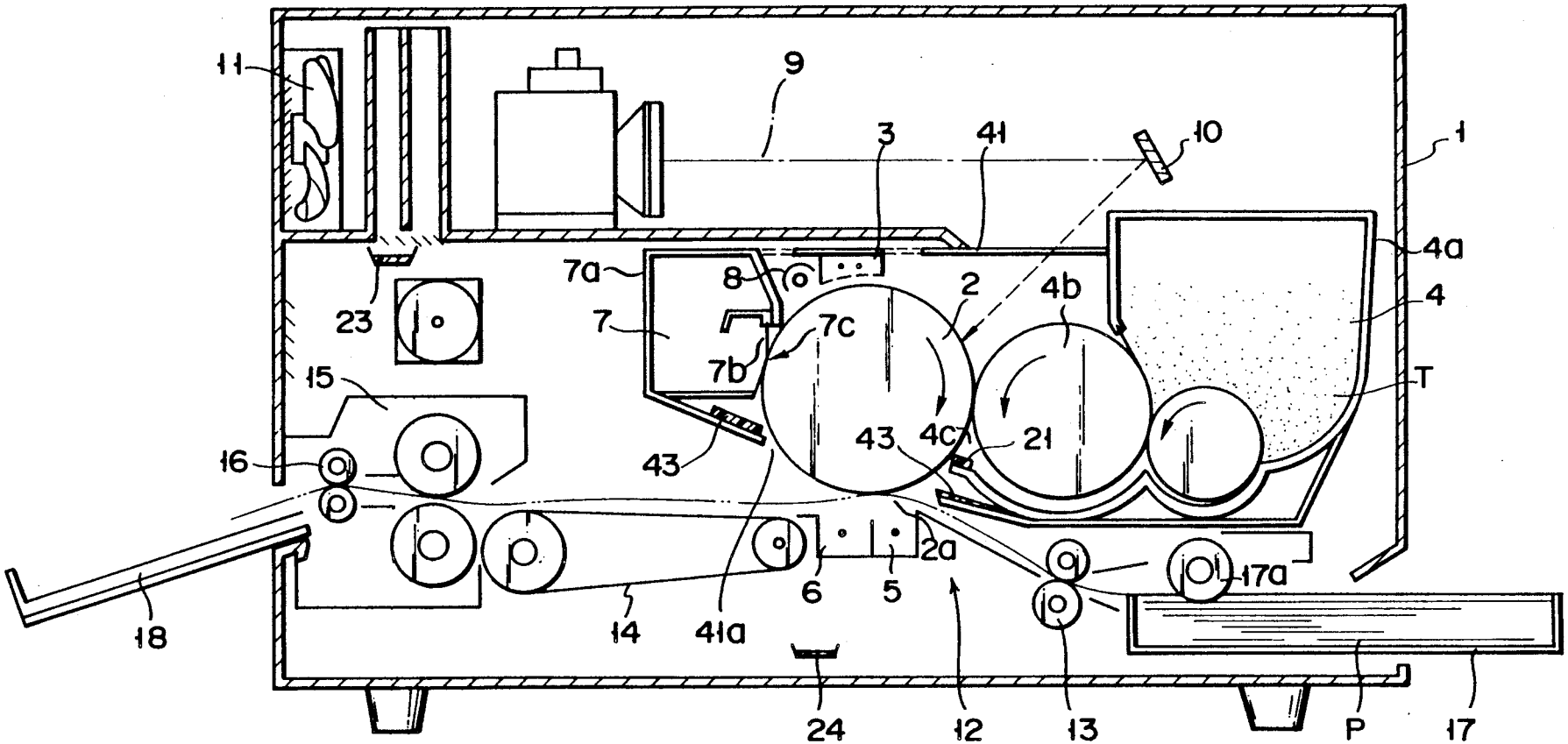
FIG. 1 is a vertical cross sectional plan view schematically showing an electrophotographic apparatus according to an embodiment of the present invention.

FIG. 1 shows an electrophotographic apparatus. The electrographic apparatus comprises a photosensitive drum 2 for carrying a latent image, a drum charger 3 for charging the photosensitive drum 2, a developing device for developing the latent image formed on the photosensitive drum 2, a transfer charger 5 for charging the paper P to transfer toner particles from the photosensitive drum 2 to the paper P, a peeling charger 6 for peeling off the paper P from the photosensitive drum 2, a cleaning device (removing means) 7 for cleaning the photosensitive drum, and a drum discharger 8 for discharging the photosensitive drum 2. The photosensitive drum 2 is arranged in a housing 1 and is rotated in a direction of an arrow. The drum charger 3, developing device 4, transfer charger 5, peeling charger 6, cleaning device 7, and drum discharger 8 are arranged around the photosensitive drum 2 in this order in the rotating direction of the photosensitive drum 2.

The developing device 4 has a casing 4*a* for containing developing powder T of toner particles, and a rotatable roller 4*b*. The developing roller 4*a* faces the photosensitive drum 2 through an opening 4*c* formed at the front area of the casing 4*a*.

A cleaning blade 7*b* is arranged within a casing 7*a* of the cleaning device 7. The cleaning blade 7*b* is brought into contact with the photosensitive drum 2 through an opening 7*c* formed at the front area of the casing 7*a*.

A laser system 9 for forming the latent image or the photosensitive drum is arranged in the upper part of the housing 1. The laser system 9 is generated in accordance with an image information. The laser beam generated from the system 9 is reflected from a reflection mirror 10 and is guided to the photosensitive drum 2 and the photosensitive drum 2 is scanned with the laser beam, thus forming the latent image on the drum 2. An exhaust fan 11 causes the air in the housing 1 to flow out.

A paper sheet convey path 12 is formed in the lower part of the housing 1. The convey path 12 includes resist rollers 13, the transfer and peeling chargers 5 and 6, a conveyor belt 14, a fixing device 15, and paper discharge rollers 1.

A paper feed cassette 17 for containing paper P (or medium on which latent images are to be transferred) is mounted on one side of the housing 1, and a paper discharge tray 18 is mounted on the other side of the body 1.

The photosensitive drum 2, the developing device 4 and the cleaning device 7 are assembled as one unit 41. The unit 41 can be freely inserted into and taken out of the housing 1.

The unit 41 has an opening 41*a* for causing the photosensitive drum 2 to face the transfer and peeling chargers 5 and 6.

In the apparatus shown in FIG. 1, the laser beam scans the photosensitive drum 2 which has been uniformly charged by the drum charger 3, and the latent image is formed on the drum 2. Then, the drum 2 on which the latent image has been formed is rotated so that the latent image is caused to face the opening 4*c* of the developing device 4. The developing roller 4*b* in the developing device 4 is rotated to apply the developing powder T to the latent image through the opening 4*c*. Thus, the latent image is developed.

At this time, a sheet of paper P is taken out of the paper feed cassette 17 by the rotation of a paper roller 17*a*. The paper sheet P is fed to the resist rollers 13 and is aligned by the rollers 13. Then, the paper sheet P is conveyed to an image transfer section 2*a* located between the photosensitive drum 2 and the transfer charger 5, and the image on the drum 2 is transferred on the paper sheet P. The paper sheet P on which the image has been transferred is peeled off the photosensitive drum 2 by the peeling charger 6. The peeled sheet P is carried to the fixing device 15 by the conveyor belt 14, and the image on the sheet P is fixed by the fixing device. The sheet P is then discharged onto the paper discharge tray 18 through the paper discharge rollers 16.

After the image on the drum 2 is transferred on the paper sheet P, the developing powder T remaining on the photosensitive drum 2 is removed by the cleaning device 7, and the removed powder is taken in the cleaning device 7 through the opening 7*c*.

A first developing powder receiving section 21 is arranged below the opening 4*c* of the developing device 4, and a second developing powder receiving section 22 is arranged below the opening 7*c* of the cleaning device 7. Further, a third developing powder receiving section 23 is provided below the exhaust fan 11, and a fourth developing powder receiving section 24 is provided below the transfer and peeling chargers 5 and 6.

Figure 2:
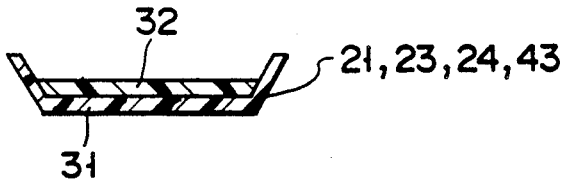
FIG. 2 is a cross sectional side view showing a developing powder receiving member used in the electrophotographic apparatus shown in FIG. 1.
Figure 3:
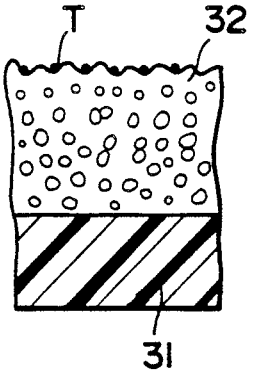
FIG. 3 is a partially enlarged cross section of the developing powder receiving member shown in FIG. 2.

As shown in FIG. 2, each of the first to fourth developing powder receiving sections 21, 23, 24 and 43 has a plastic container 31 which is not compatible with metal such as aluminum, or plasticizer. A sponge 32 of urethane foam or the like is placed in the container 31. The sponge 32 is impregnated with a plasticizer.

The developing powder T is toner consisting mainly of a resin-based coloring agent such as carbon black, and a small amount of an electrification control agent. The resin used in the coloring agent is, for example, styrene-acrylic copolymer, epoxy resin, or polyester resin. This resin is heated or dissolved in a solution of toluene or tetrahydrofuran, so that the resin is softened or melted to have a viscous phase. This process, however, is dangerous because materials having volatility, flammability and toxicity are employed. In addition, there is no means for holding the molten resin.

In the present invention, a specific plasticizer is used to soften or melt the resin in toner, thereby giving adhesive properties to the toner. According to the invention, there is provided means for making the toner adhesive, whereby the toner is easily installed and held. Since the solution is not used for melting the resin, there is no fear of flow-out or evaporation of solution.

Conventionally, a plasticizer has been used as an additive for providing a flexibility to a plastic material. In the present invention, however, some plasticizers are combined and a predetermined amount of the combined plasticizer is applied to toner. Consequently, the toner is provided with adhesion, and the toner is prevented from falling or dispersing from the container 31. Thus, in the present invention, the plasticizer is not simply used as softeners, but is used for the special purpose.

In particular, the plasticizer used in the present invention is a phthalate-based plasticizer such as dibutyl phthalate ($C_6H_4(COOC_4H_9)_2$), diheptyl phthalate ($C_6H_4(COOC_7H_{15})_2$), or dioctyl phthalate ($C_6H_4(COOC_8H_{17})_2$). The phthalate-based plasticizer is well reacted with stirene-acryl-based toner, and the toner is made viscous.

Also, an aliphatic acid-based plasticizer such as dioctyl adipic acid ($C_4H_8(COOC_8H_{17})_2$), dioctyl sebacic acid ($C_8H_{16}(COOC_8H_{17})_2$), or epoxy-based plasticizers and polyester-based plasticizers act on the styrene-acryl-based toner effectively. A sebacic acid-based plasticizer and an adipic acid-based plasticizer act on polyester resin-based toner effectively.

Referring back to the operation of the electrophotographic apparatus shown in FIG. 1, while the image is recorded on the paper sheet, the developing powder T, which is very light, disperses or falls from the opening 4*c* of the developing device 4, the opening 7*a* of the cleaning device 7, the transfer and peeling chargers 5 and 6, or the exhaust fan 11.

If the unit 41 is inclined or jolted while the unit 41 is inserted into or taken out of the housing 1, the developing powder T may be dispersed or fallen.

The developing powder T dispersed or fallen from the opening 4*c* of the developing device 4 is received in the first developing powder receiving section 21. The developing powder T dispersed or fallen from the opening 7*a* of the cleaning device 7 is received in the second developing powder receiving section 22. Also, the developing powder T dispersed or fallen from the transfer and peeling chargers 5 and 6 is received in the third developing powder receiving section 23, and the powder T dispersed or fallen from the exhaust fan 11 is received in the fourth developing powder receiving section 24. The developing powder T dispersed or fallen from the opening 41*a* of the unit 41 is received by the fourth receiving section 43.

The developing powder T received in the first to fourth receiving sections 21, 23, 24 and 43 is reacted with the plasticizer, and is then softened or melted after the reaction of twelve to twenty-four hours. The softened or melted powder T is adhered to the inner surface of the container 31. A plasticizer intends to infiltrate into the resin with which it reacts. Thus, even if developing powder T is accumulated continuously, the plasticizer continues to react with and soften the powder T until the amount of the plasticizer becomes insufficient.

According to the present invention, the inside of the housing 1 is not contaminated by the developing powder T dispersed or fallen from the developing device 4, cleaning device 7, exhaust fan 11, transfer charger 5, or peeling charger 6. Nor is the contamination due to the powder T spread with in the body 1.

According to the present invention, a much greater amount of developing powder T can be caught, compared to the conventional technique of using an adhesive tape. Thus, the dispersion or falling of the powder T can be surely prevented for a long time.

In addition, the cost for preventing the dispersion or falling of developing powder can be reduced, compared to the conventional technique of employing the magnetic toner and magnet.

Furthermore, various developing means can be used, and the color of toner can be selected. Thus, the present invention is very convenient.

Figure 4:
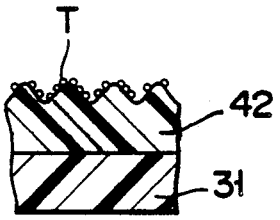
FIG. 4 is a cross sectional side view showing a modification of the receiving member shown in FIG. 3.

The structure of each of the first to fourth developing powder receiving sections 21, 23, 24 and 43 is not limited to the first embodiment. As shown in FIG. 4, it is possible to provide an uneven resin layer 42 of vinyl chloride or the like, and to impregnate the resin layer 42 with a plasticizer.

According to the above embodiment, even if the receiving sections are tilted while the developing powder T is not fully melted just after the dispersion or falling, the powder T is caught on the uneven surface and the flow-out of the powder T can be mechanically prevented.

When the plasticizer has no fluidity or volatility, it may be coated, as such, on the surface of the container 31, or, after the plasticizer is dissolved in a solvent, it may be coated on the surface of the container 31.

Each of the developing powder receiving sections 21, 23, 24 and 43, or only the sponge 32 or resin layer 42 thereof may be replaced with a new one, independently from the apparatus body 1, whereby the inside of the body 1 can be kept clean for a long time.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An apparatus for forming an image on a recording medium, comprising:

an image bearing member;

means for forming the latent image on said image bearing member;

means for developing the latent image on said image bearing member with a developing powder;

means for transferring the developed image formed on said bearing member to the recording medium;

means for removing the developing powder remaining on the image bearing member to clean the image bearing member, after the developed image is transferred onto the recording medium;

a unit having said developing means and said removing means;

means for housing said unit, said image forming means and said transferring means, said receiving unit being detachably mounted in said housing means; and means for collecting the developing powder which is dispersed or fallen from said unit, which includes a means for chemically processing the collected developed powder.

2. The apparatus according to claim 1, wherein said chemical processing means includes a material for chemically softening or melting the collected developed powder.

3. The apparatus according to claim 1, wherein said said developing powder is toner particles, each including a resin-based coloring agent and a small amount of electrification control agent.

4. The apparatus according to claim 3, wherein the resin contained in said resin-based coloring agent is one of styrene-acrylic copolymer, epoxy resin, and polyester resin.

5. The apparatus according to claim 1, wherein said collecting means comprises a container and a sponge provided in said container and impregnated with a plasticizer.

6. The apparatus according to claim 5, wherein said plasticizer is a phthalate-based plasticizer such as dibutyl phthalate ($C_6H_4(COOC_4H_9)_2$), diheptyl phthalate ($C_6H_4(COOC_7H_{15})_2$), or dioctyl phthalate ($C_6H_4(COOC_8H_{17})_2$)

7. The apparatus according to claim 5, wherein said plasticizer is an aliphatic acid-based plasticizer such as dioctyl adipic acid ($C_4H_8(COOC_8H_{17})_2$), or dioctyl sebacic acid ($C_8H_{16}(COOC_8H_{17})_2$)

8. The apparatus according to claim 5, wherein said plasticizer is an epoxy-based plasticizer.

9. The apparatus according to claim 5, wherein said plasticizer is a polyester-based plasticizer.

10. The apparatus according to claim 5, wherein said plasticizer is a sebacic acid-based plasticizer.

11. The apparatus according to claim 5, wherein said plasticizer is an adipic acid-based plasticizer.

12. An apparatus for forming an image on a recording medium, comprising:

an image bearing member;

means for acting on said image bearing member;

a unit having said image bearing member and said acting means, and removably located on a body of said apparatus; and means for collecting a developing powder which is dispersed or fallen from said unit, said collecting means having mean for chemically processing the collected developed powder.

* * * * *